US006840508B2

(12) United States Patent
Krlin et al.

(10) Patent No.: US 6,840,508 B2
(45) Date of Patent: Jan. 11, 2005

(54) PUSH BUTTON AIR PRIMER FOR CARBURETOR

(75) Inventors: Pavel Krlin, Ceske Budejovice (CZ); Josef Levy, Vcelna (CZ); Jan Sustr, Hluboka nad Vitaviu (CZ); Neil Veldman, Plymouth, WI (US); Frantisek Sindelir, Ceske Budejovice (CZ); Daniel Lebduska, Ceske Budejovice (CZ)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/697,480

(22) Filed: Oct. 30, 2003

(65) Prior Publication Data

US 2004/0178520 A1 Sep. 16, 2004

Related U.S. Application Data

(63) Continuation-in-part of application No. 10/387,829, filed on Mar. 13, 2003.

(51) Int. Cl.[7] ..... F02M 1/16

(52) U.S. Cl. ..... 261/35; 123/179.11; 261/DIG. 8; 261/DIG. 67

(58) Field of Search ..... 261/35, DIG. 8, 261/DIG. 67, DIG. 73; 123/179.11

(56) References Cited

U.S. PATENT DOCUMENTS

| | | | | | |
|---|---|---|---|---|---|
| 1,183,183 | A | * | 5/1916 | Funerburk | 261/141.1 |
| 3,177,920 | A | | 4/1965 | Phillips | 158/36.4 |
| 3,307,836 | A | | 3/1967 | Arndt et al. | 261/34 |
| 3,948,589 | A | | 4/1976 | DuBois | 417/487 |
| 3,978,839 | A | | 9/1976 | DuBois et al. | 123/187.5 R |
| 4,228,110 | A | | 10/1980 | Magnet | 261/37 |
| 4,309,968 | A | | 1/1982 | DuBois | 123/187.5 R |
| 4,411,844 | A | | 10/1983 | Morris et al. | 261/34 R |
| 4,589,386 | A | | 5/1986 | Everts | 123/187.5 R |
| 4,660,516 | A | | 4/1987 | Baltz et al. | 123/179.9 |
| 4,747,760 | A | | 5/1988 | Eberl et al. | 417/443 |
| 4,926,808 | A | | 5/1990 | Kandler | 123/187.5 R |
| 5,070,829 | A | * | 12/1991 | Guntly et al. | 123/179.9 |
| 5,071,325 | A | | 12/1991 | Tupper et al. | 417/496 |
| 5,664,532 | A | | 9/1997 | August | 123/179.11 |
| 5,711,901 | A | * | 1/1998 | Berg et al. | 261/35 |
| 5,740,781 | A | * | 4/1998 | Scott et al. | 123/437 |
| 6,152,431 | A | | 11/2000 | Stenz et al. | 261/34.1 |
| 6,374,782 | B2 | | 4/2002 | Ishikawa et al. | 123/73 AF |
| 6,561,495 | B2 | * | 5/2003 | Woody | 261/37 |
| 6,595,500 | B2 | * | 7/2003 | Osburg et al. | 261/34.2 |

FOREIGN PATENT DOCUMENTS

| | | | | |
|---|---|---|---|---|
| JP | 1-190954 | * | 8/1989 | 261/DIG. 8 |
| JP | 2-204668 | * | 8/1990 | 261/DIG. 8 |

* cited by examiner

*Primary Examiner*—Richard L. Chiesa
(74) *Attorney, Agent, or Firm*—Baker & Daniels

(57) ABSTRACT

A primer assembly is provided including a resilient primer bulb which, along with the carburetor body, defines a variable volume priming chamber. A plunger or blocking element is slidably disposed within the priming chamber. Upon initial depression of the primer bulb, the primer bulb engages and depresses the plunger element toward the carburetor body to seal off an internal vent passage from the primer chamber and the fuel bowl. Thereafter, further depression of the primer bulb forces air from within the primer chamber into the fuel bowl to pressurize the fuel bowl and force an amount of fuel into the throat of the carburetor for priming. Advantageously, the plunger element functions to effectively seal the internal vent passageway from the primer chamber and fuel bowl regardless of the direction from which the primer bulb is depressed.

24 Claims, 7 Drawing Sheets

PUSH BUTTON AIR PRIMER FOR CARBURETOR

CROSS REFERENCE TO RELATED APPLICATIONS

This application is a continuation-in-part of U.S. patent application Ser. No. 10/387,829, entitled PUSH BUTTON AIR PRIMER FOR CARBURETOR, filed on Mar. 13, 2003.

BACKGROUND OF THE INVENTION

1. Field of the Invention

The present invention relates to carburetors and, particularly, to carburetors for small internal combustion engines of the type used with lawn mowers, lawn tractors, and small implements, as well as sport vehicles.

2. Description of the Related Art

Small internal combustion engines typically include a carburetor, which provides an air-fuel combustion mixture to the engine. One type of carburetor commonly used in small engines includes a fuel bowl for storing fuel and a throat with a venturi region through which air is drawn and into which fuel is drawn for mixing with the intake air. When the pressure in the fuel bowl is greater than the pressure in the venturi region, as is the case when the engine is running, fuel is drawn from the fuel bowl and conveyed through a conduit to the venturi region where it is mixed with air and supplied to the engine.

When the engine is at rest, the pressure in the fuel bowl is not greater than the pressure in the venturi region, and therefore, fuel is not drawn from the fuel bowl into the venturi region. In order to start the engine, the carburetor must be primed so that an adequate air-fuel mixture is supplied to the engine. Typically, to prime the engine, the fuel bowl is pressurized to force an amount of priming fuel from the fuel bowl into the venturi region to provide an enriched air/fuel mixture for engine starting.

One primer system includes a resilient primer bulb or bellows that, when manually depressed, increases the pressure in the fuel bowl, causing an amount of priming fuel to flow from the fuel bowl through a nozzle into the carburetor throat. In some of these systems, the primer bulb itself also serves as a check valve to seal off an internal vent passage within the carburetor, such that air within a priming chamber is directed into the fuel bowl to pressurize the fuel bowl.

The foregoing priming systems require an operator to manually depress a priming bulb which may present potential problems. For instance, if the operator does not depress the bulb completely, the resulting pressure in the fuel bowl may be inadequate to cause a sufficient amount of fuel to flow into the throat. In addition, the primer bulb is most effective as a check valve when it is depressed directly inwardly toward the carburetor along a straight line. If the operator depresses the bulb at an angle, the bulb may not effectively seal off the internal vent passage, allowing air to leak into the internal vent passage such that the fuel is not pressurized sufficiently to provide priming fuel to the carburetor throat in an amount effective for engine starting. Thus, multiple depressions of the primer bulb may be requried.

A number of other primer systems use a primer bulb to introduce liquid fuel directly into the carburetor throat. In these systems, fuel is drawn into the primer bulb when the bulb is depressed and released. When the primer bulb is depressed again, the fuel contained in the primer bulb is forced from the bulb to the throat. This system poses similar disadvantages. If the primer bulb is not depressed completely, the fuel injected from the bulb to the throat may be insufficient to start the engine.

Other primer systems have been developed which include complex electronic devices that sense engine temperature and fuel line pressure. When a certain threshold is sensed, the electronic primer advises the user to terminate manual priming. However, the inclusion of electronic devices in a priming system significantly increases the manufacturing costs of the priming system.

It is desired to provide a primer system for small engine carburetors that is an improvement over the foregoing.

SUMMARY OF THE INVENTION

The present invention provides a push button air primer for a small internal combustion engine that is simple, durable, inexpensive and easy to operate. The primer includes a priming piston slidably housed in a primer housing and a sealing piston slidably housed in the priming piston. To prime the carburetor, the operator depresses the priming piston causing both the priming piston and the sealing piston to slide within the primer housing until the sealing piston reaches the surface of the carburetor body. At this point, sealing piston bears against the carburetor body to seal an opening to the internal vent passage. Further sliding of the priming piston within the chamber forces air from the housing into a fuel bowl, thereby pressurizing the fuel bowl and forcing a quantity of priming fuel from the fuel bowl into the throat of the carburetor.

The push button air primer of the present invention is a simple mechanical structure, therefore the cost of assembly is relatively low. In addition, the parts thereof are also relatively low in cost. For these reasons, the push button air primer of the present invention is relatively inexpensive to manufacture. Also, the push button primer of the present invention is simple to operate, and the rigidity of the parts, as well as the guided, sliding relationship therebetween restricts the primer movement to a straight line, thereby reducing the potential for operator errors.

In another embodiment, a primer assembly is provided including a resilient primer bulb which, along with the carburetor body, defines a variable volume priming chamber. A plunger or blocking element is slidably disposed within the priming chamber. Upon initial depression of the primer bulb, the primer bulb engages and depresses the plunger element toward the carburetor body to seal off an internal vent passage from the primer chamber and the fuel bowl. Thereafter, further depression of the primer bulb forces air from within the primer chamber into the fuel bowl to pressurize the fuel bowl and force an amount of fuel into the throat of the carburetor for priming. Advantageously, the plunger element functions to effectively seal the internal vent passageway from the primer chamber and fuel bowl regardless of the direction from which the primer bulb is depressed.

In one form thereof, the present invention provides a carburetor, including a carburetor body having a throat; a fuel bowl connected to the carburetor body and storing a quantity of fuel, the fuel bowl in fluid communication with the throat; an internal vent passage in fluid communication with the throat; and a primer assembly, including a piston assembly slidably supported by the carburetor body, the piston assembly and the carburetor body defining a variable volume primer chamber therebetween in fluid communication with the fuel bowl and with the internal vent passage, the piston assembly slidable with respect to the carburetor body to vary the volume of the primer chamber, the piston assembly including a portion moveable into blocking engagement with the internal vent passage to allow displacement of air from the primer chamber into the fuel bowl.

In another form thereof, the present invention provides a carburetor, including a carburetor body having a throat; a fuel bowl connected to the carburetor body and storing a quantity of fuel, the fuel bowl in fluid communication with the throat; an internal vent passage in fluid communication with the throat; and a primer assembly, including a resilient primer bulb mounted to the carburetor body, the primer bulb and the carburetor body defining a variable volume primer chamber therebetween in fluid communication with the fuel bowl and with the internal vent passage, the primer bulb depressible to vary the volume of the primer chamber; and a blocking element disposed within the primer chamber and movable into blocking relationship with the internal vent passage upon depression of the primer bulb to allow displacement of air from the primer chamber into the fuel bowl.

In a further form thereof, the present invention provides a method of priming a carburetor for starting an internal combustion engine, including the steps of depressing a resilient primer bulb to move a blocking element into blocking relationship with an internal vent passage of the carburetor to seal a fuel bowl of the carburetor from the internal vent passage; and depressing the primer bulb further to displace air from within the primer bulb into the fuel bowl to pressurize the fuel bowl and force fuel from the fuel bowl into a throat of the carburetor.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 1:
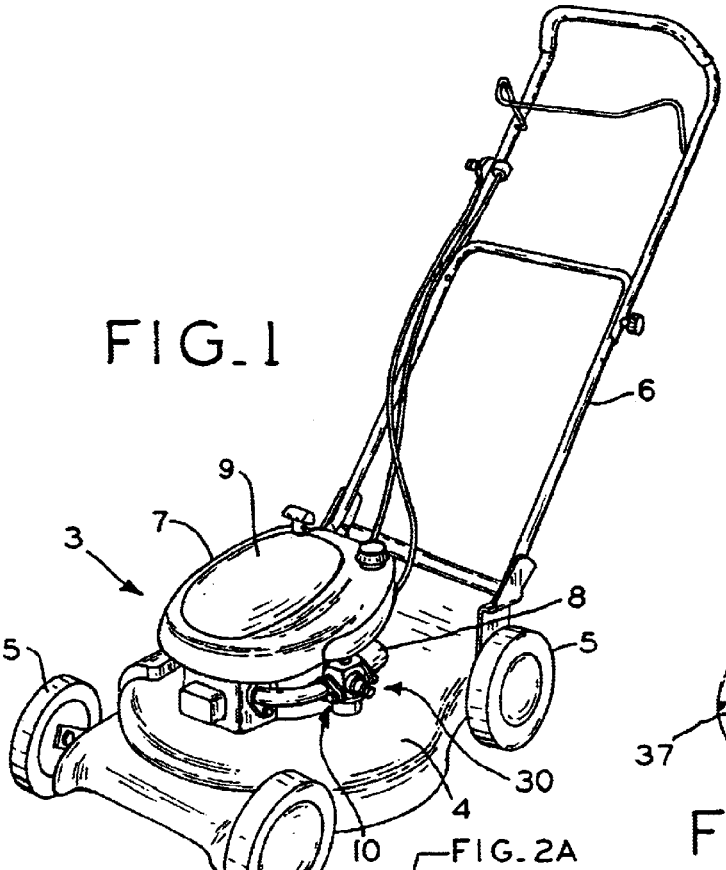
FIG. 1 is a perspective view of a lawn mower including a carburetor with a primer assembly in accordance with the present invention.

Referring to FIG. 1, an exemplary implement is shown, for example, as lawnmower 2, which includes engine 3 mounted to mower deck 4. Lawnmower 2 additionally includes wheels 5 and handle 6 mounted to mower deck 4. Housing 7 of engine 3 includes crankcase 8 and blower housing or shroud 9. The working components of engine 3 (not shown), such as a crankshaft, connecting rod and piston assembly, are housed within crankcase 8. Carburetor 10 is connected to engine housing 7, and includes push button primer assembly 30, described below, which is easily accessible by an operator. Although primer assembly 30 is shown in FIG. 1 associated with carburetor 10 of engine 3 of lawnmower 2, primer assembly 30 may be used with carburetors for a variety of small internal combustion engines used with a variety of implements, such as snow throwers, tillers, and the like.

Figure 2A:
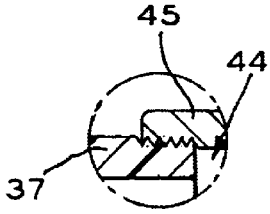
FIG. 2A is an enlarged fragmentary view of the encircled portion in FIG. 2.
Figure 2:
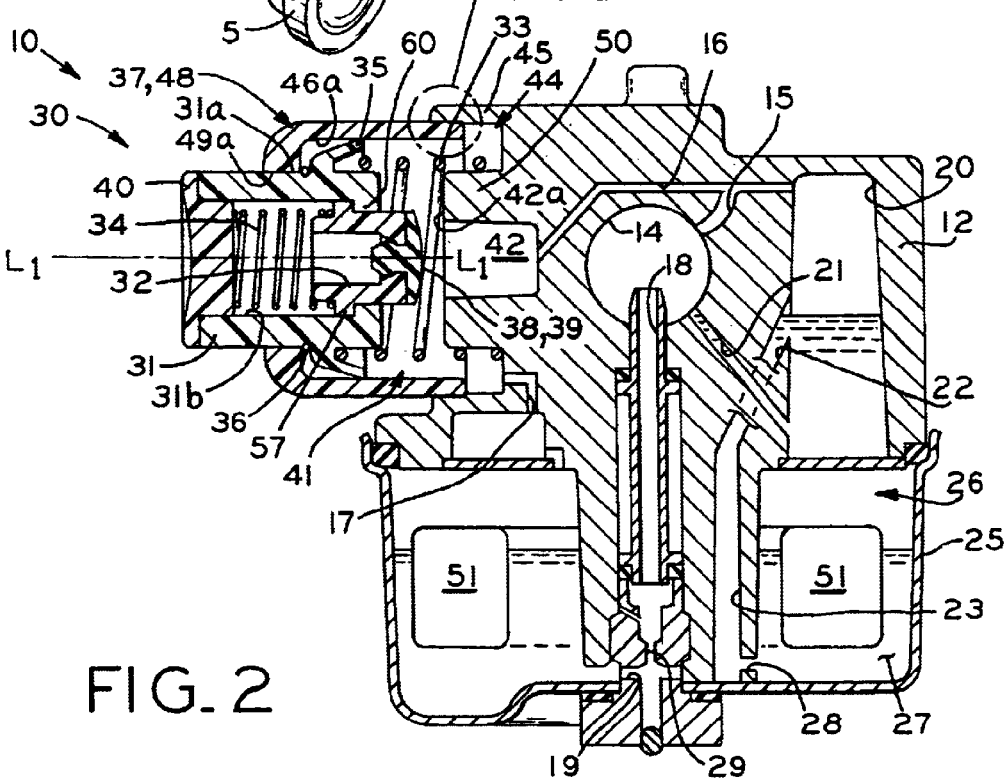
FIG. 2 is a sectional view of the carburetor of FIG. 1, including a primer assembly in accordance with a first embodiment, the primer assembly disposed in a first position.

FIG. 2 illustrates carburetor 10 for providing a combustible fuel/air mixture to engine 3. Carburetor 10 includes may features similar to the carburetors disclosed in U.S. Pat. Nos. 4,926,808 and 6,152,431, each assigned to the assignee of the present invention, which patents are incorporated herein by reference, and carburetor 10 further includes primer assembly 30, described below.

Carburetor 10 generally includes a carburetor body 12 having an air mixture-passage or throat 14, which is in communication with the combustion chamber (not shown) of engine 3. Carburetor body 12 is connected to fuel bowl 25, which stores an amount of fuel 27 and contains air space 26 above fuel 27. Air space 26 of fuel bowl 25 is at atmospheric pressure when engine 3 is not running as a result of the internal venting of carburetor 10 through priming passage 17, which communicates to the atmosphere through internal vent passage 16 connected to throat 14. Internal vent passage 16 connects cavity 42 within boss 50 of carburetor body 12 with extended prime fuel chamber 20, and further includes throat vent passage 15 opening into throat 14.

During running of engine 3, the vacuum within the venturi region of throat 14 draws fuel 27 from fuel bowl 25 through fuel orifice 19 and conduit orifice 29, and upwardly through conduit 18 into throat 14. Float 51 floats on fuel 27 within fuel bowl 25, and is operatively connected to a valve (not shown) for metering the supply of fuel into fuel bowl 25 from a fuel tank (not shown) as fuel 27 is consumed by engine 3.

Figure 3:
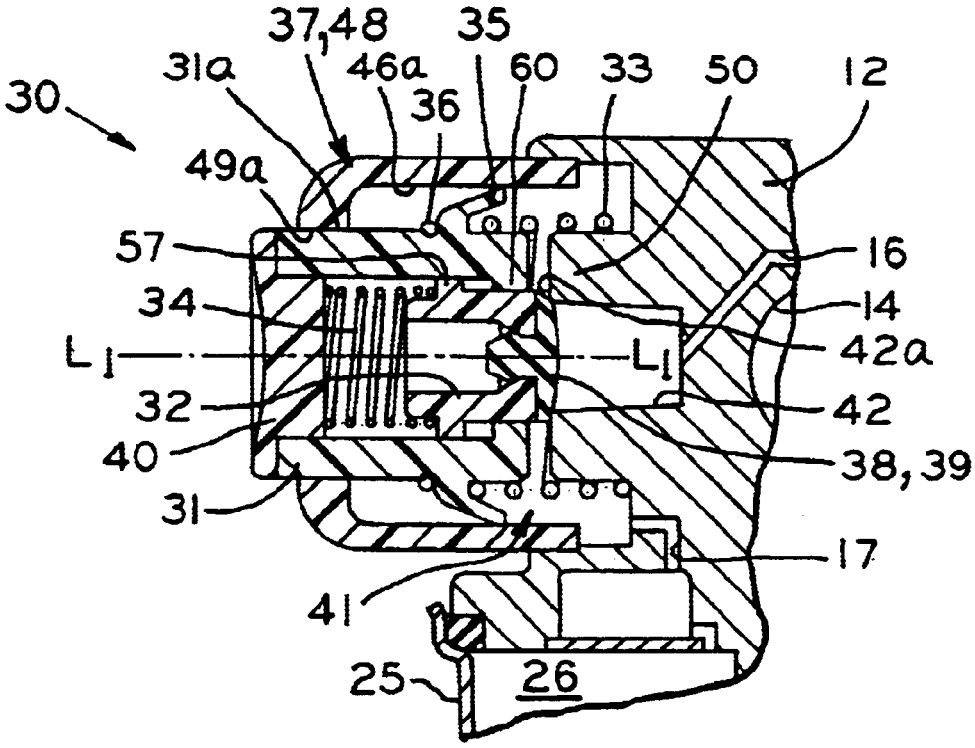
FIG. 3 is a sectional view of the carburetor of FIG. 1, showing the primer assembly disposed in a second position.
Figure 4:
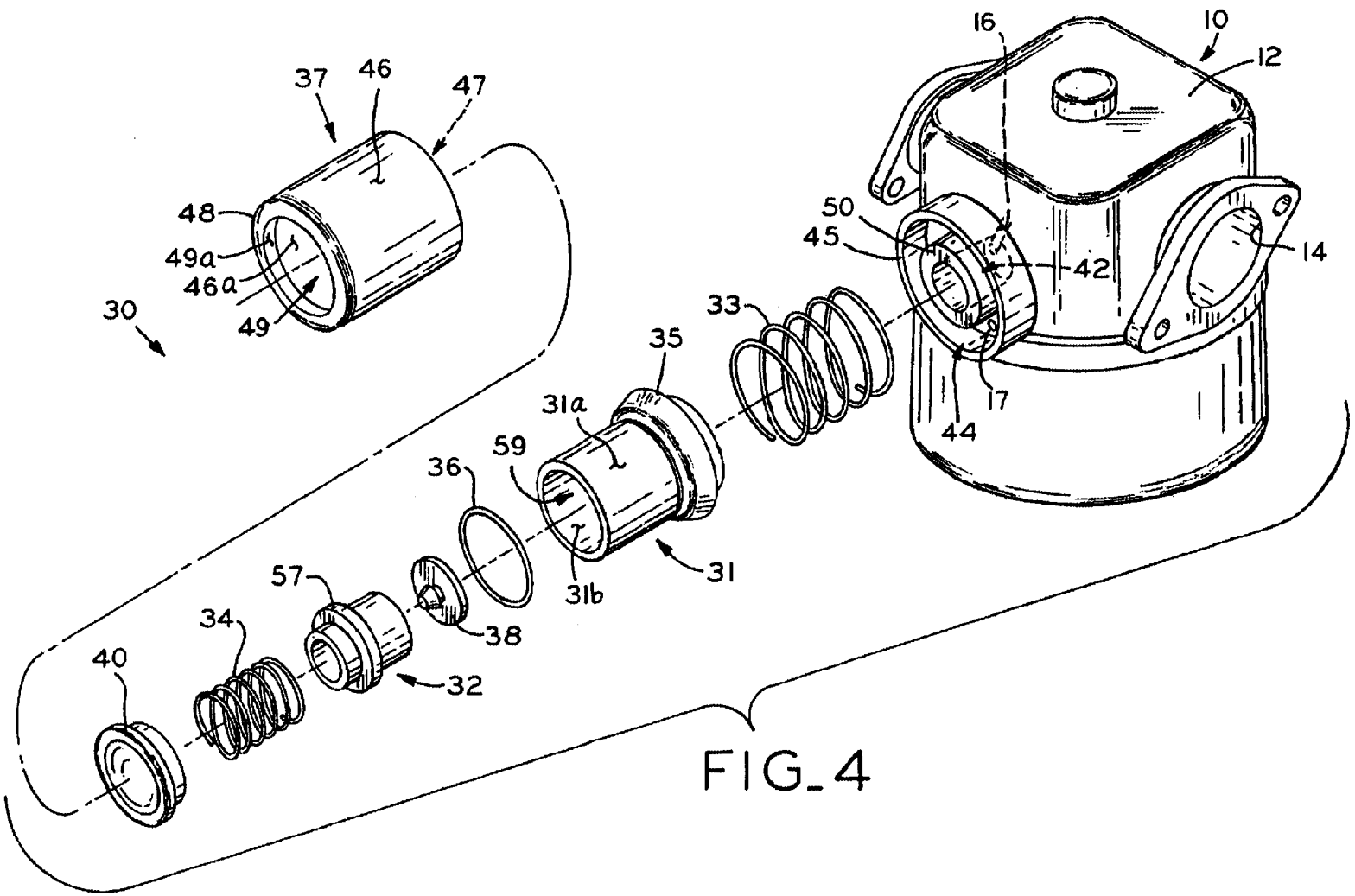
FIG. 4 is an exploded view, showing the components of the primer assembly of FIGS. 2 and 3.

In order to prime engine 3, carburetor 10 is provided with a push button primer assembly 30. Referring now to FIGS. 2–4, primer assembly 30 generally includes primer housing 37 defining a priming chamber 41 between primer housing 37 and carburetor body 12, priming piston 31 slidably housed within primer housing 37, sealing piston 32 slidably housed within priming piston 31, first return spring 33, and second return spring 34. Primer chamber 41 is in communication with internal vent passage 16 via cavity 42, and is also in communication with fuel bowl 25 via priming passage 17.

Primer housing 37 is generally cup-shaped, having a substantially cylindrical wall 46, an open end 47 and an opposite end 48 having opening 49 with inner annular surface 49*a*. Primer housing may be formed from metal, or a semi-rigid or rigid plastic material. Open end 47 of primer housing 37 is rigidly mounted, via a press-fit engagement, for example, within annular recess 44 which is formed by annular wall 45 of carburetor body 12. Alternatively, as shown in FIG. 2A, primer housing 37 may be rigidly mounted within annular recess 44 in a screw-threaded engagement. End 48 of primer housing 37 defines opening 49 through which priming piston 31 is slidably received. Priming piston 31 is substantially cylindrical, and includes exterior surface 31*a* and interior surface 31*b*. Priming piston 31 may be made from a semi-rigid plastic material, for example, such as Celcon® M90, available from Ticona Inc., 90 Morris Ave., Summit, N.J. 07901. (Celcon® is a registered trademark of Celanese Corp., 522 5th Ave., New York, N.Y. 10036).

Priming piston 31 is closely received within opening 49 of primer housing 37, such that exterior surface 31*a* of priming piston 31 engages interior surface 49*a* of opening 49 of primer housing 37, as shown in FIGS. 2 and 3. In this manner, primer housing 37 supports primer piston 31 for sliding movement which is confined along line $L_1$—$L_1$. Although line $L_1$–$L_1$ is shown in FIGS. 2 and 3 generally perpendicular to throat 14 of carburetor 10, line $L_1$—$L_1$ may be oriented along any direction.

Priming piston 31 also includes rim 60 (FIG. 2) at one end thereof, and defines a cylindrical cavity 59 extending the length of priming piston 31. Priming piston 31 further includes stopper 40 fit into the end of priming piston opposite rim 60 for closing cavity 59. Priming piston 31 is provided with an annular, external lip seal 35 therearound, which is radially compressed when priming piston 31 is inserted into primer housing 37, and which bears against inner surface 46*a* of cylindrical wall 46 of primer housing 37, thereby providing a sliding, sealing engagement between lip seal 35 of priming piston 31 and wall 46 of primer housing 37.

Sealing piston 32 is slidably mounted within cylindrical cavity 59 of priming piston 31, and includes a stop flange 57 protruding radially from the outer surface of sealing piston 32. Stop flange 57 engages inner surface 31*b* of priming piston 31, such that sealing piston 32 is supported within priming piston 31 for sliding movement which is confined along line $L_1$—$L_1$. Stop flange 57 limits the sliding movement of sealing piston 32 within priming piston 31 by engaging rim 60 of priming piston 31, as shown in FIG. 2. Sealing piston 32 also includes a plug 38 having a sealing surface 39 sized to sealingly engage opening 42*a* of cavity 42. Sealing piston 31 may be made from a semi-rigid plastic material, for example, such as Celcon® M90, available from Ticona Inc., 90 Morris Ave., Summit, N.J. 07901. (Celcon® is a registered trademark of Celanese Corp., 522 5th Ave., New York, N.Y. 10036). Plug 38 may be made from rubber, or any suitable compressible elastomeric material.

As shown in FIGS. 2 and 3, first return spring 33 is mounted under compression within primer housing 37, with a first end thereof seated against carburetor body 12, and an opposite, second end thereof seated within external lip seal 35 of priming piston 31. In this manner, the bias force of spring 33 aids in maintaining the sealing engagement between lip seal 35 of priming piston 31 and the inner surface 46*a* of cylindrical wall 46 of primer housing 37. Second return spring 34 is mounted under compression within cylindrical cavity 59 of priming piston 31, with a first end thereof seated against stop flange 57 of sealing piston 32, and a second end thereof seated against stopper 40 of priming piston 31. As shown in FIG. 2, first return spring 33 biases priming piston 31 away from carburetor body 12 along line $L_1$—$L_1$, while second return spring 34 biases sealing piston 32 away from stopper 40 and toward carburetor body 12 along $L_1$—$L_1$.

To prime the engine for starting, the operator pushes against stopper 40 thereby compressing first return spring 33 and sliding priming piston 31 and sealing piston 32 together along line $L_1$—$L_1$ within priming chamber 41 toward carburetor body 12. As shown in FIG. 2, when sealing piston 32 reaches carburetor body 12, sealing surface 39 of plug 38 seats against boss 50 of carburetor body 12, thereby sealing off opening 42*a* to internal vent passage 16. Sealing piston 32 is held in this position by second return spring 34, which biases sealing piston 32 toward boss 50 of carburetor body 12 to maintain the foregoing seal. The close sliding engagement between priming piston 31 and primer housing 37, as well as between priming piston 31 and sealing piston 32, prevents the angular displacement of priming piston 31 and sealing piston 32 away from line $L_1$—$L_1$, thus ensuring that sealing surface 39 of plug 38 is aligned with, and sealingly engages boss 50 of carburetor body 12 to seal internal vent passage 16 from priming chamber 41. In this manner, priming assembly 30 reduces the possibility of operator error.

Further movement of priming piston 31 within priming chamber 41 forces air contained within priming chamber 41 through bowl vent passage 17 to fuel bowl 25 to pressurize fuel bowl 25. As priming piston 31 slides within priming chamber 41, external lip seal 35 of priming piston 31 sealingly engages cylindrical wall 46 of primer housing 37 to seal priming chamber 41 and prevent air from leaking from priming chamber 41 into the atmosphere.

The increase in pressure in fuel bowl 25 causes a portion of fuel 27 to flow from fuel bowl 25 to throat 14 via conduit 18. The fuel forced into throat 14 via conduit 18 is mixed with air to form a rich air/fuel mixture, which is supplied to the combustion chamber (not shown) of the engine to aid in engine starting. When the operator releases priming piston 31, first return spring 33 biases priming piston 31 outward from carburetor body 12, thus releasing sealing piston 32 from its sealing position and opening internal vent passage 16 to allow air into priming chamber 41 through internal vent passage 16. When priming piston 31 and sealing piston 32 return to the position shown in FIG. 1, O-ring 36, positioned around priming piston 31 adjacent lip seal 35, is captured and compressed between lip seal 35 and end 48 of primer housing 37 to prevent dust from entering priming chamber 41.

As illustrated in FIG. 2, carburetor 10 can also include an extended prime fuel chamber 20, for providing a rich air-fuel mixture to last through engine warm up. Extended prime fuel chamber 20 is similar to the extended prime fuel chamber disclosed in U.S. Pat. No. 6,152,431. The lower portion of extended prime fuel chamber 20 communicates with throat 14 though extended prime fuel passage 21 and the upper portion of extended prime fuel chamber 20 communicates with internal vent passage 16. Extended prime fuel chamber also communicates with the lower portion of fuel bowl 25 through a pair of interconnected fuel fill passages 22, 23 and metering orifice 28.

Priming a carburetor having an extended prime fuel chamber is essentially as described above except that the increase in pressure in fuel bowl 25 causes fuel to flow not only to throat 14, but also to extended prime fuel chamber 20 via fuel fill passages 22, 23. Once the engine starts, fuel is drawn from extended prime fuel chamber 20 to throat 14 via prime fuel passage 21 to provide an enriched air/fuel mixture through a warm-up running period of engine 3, until extended prime fuel chamber 20 is empty.

Figure 5:
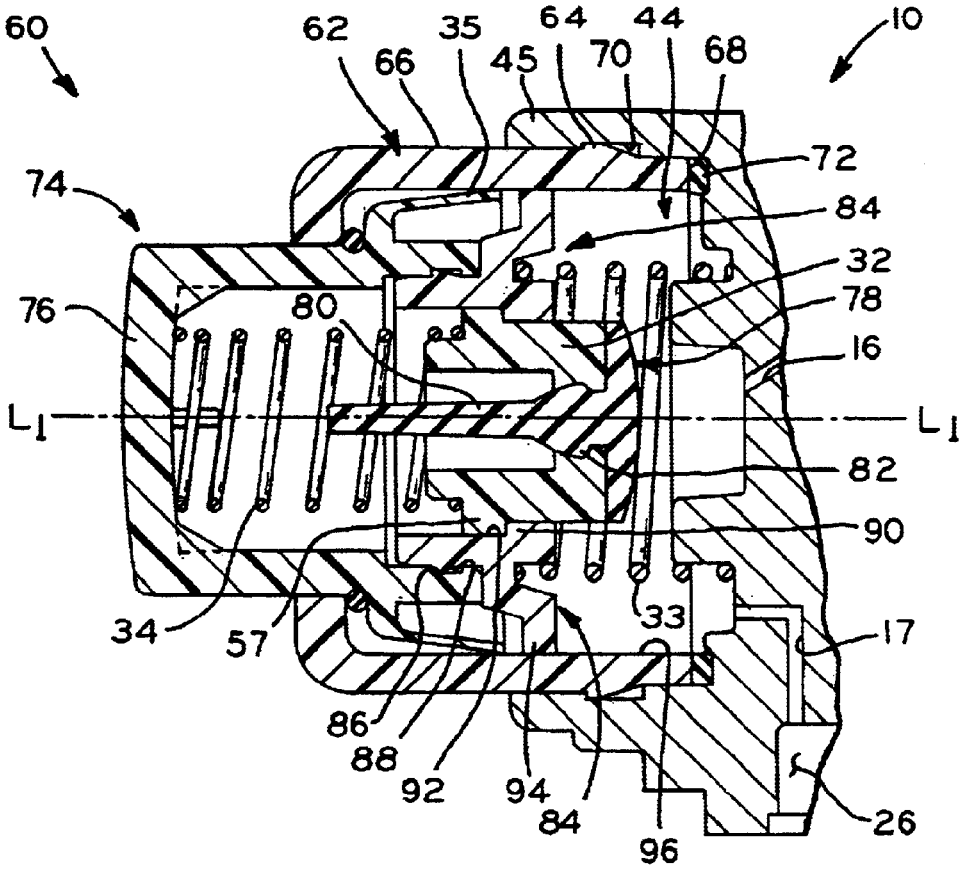
FIG. 5 is a fragmentary view of a portion of the carburetor of FIG. 1, showing a primer assembly in accordance with a second embodiment.

Referring to FIG. 5, primer assembly 60 is shown, according to a second embodiment. The components and operation of primer assembly 60 are substantially identical to the components and operation of primer assembly 30, except as described below, and like reference numerals have been used to designate identical components therebetween.

Primer assembly 60 includes primer housing 62 having annular ridge or tooth 64 projecting from outer surface 66 thereof adjacent its open end 68. Ridge 64 is received and retained in a locking manner within annular groove 70 around the interior of wall 45 of carburetor 10 when primer housing 62 is pressed into annular recess 44 of carburetor 10 to thereby fixedly attach primer housing 62 to carburetor 10. Also, a compressible O-ring 72 is provided between primer housing 62 and carburetor 10 to provide a seal therebetween.

Priming piston 74 is formed with an integral closed end portion 76 such that the need for stopper 40 is obviated. Also, plug 78 is formed with an elongated tail portion 80 which may be grasped by a suitable tool for pulling plug 78 into the open end of sealing piston 32, until ridge 82 of plug 78 locks within a corresponding recess of sealing piston 32 to mount plug 78 to sealing piston 32.

Primer assembly 60 additionally includes guide plate 84, an annular component disposed between priming piston 74 and sealing piston 32. Specifically, guide plate 84 abuts the open end of priming piston 74 and may be attached to primary piston 74 by engagement of ridge 86 of guide plate 84 within groove 88 of priming piston 74. Guide plate 84 also includes shoulder 90 abutting stop flange 57 of sealing piston 32. Stop flange 57 of sealing piston 32 is slidable with respect to inner surface 92 of guide plate 84. Guide plate 84 also includes outer rim 94, which is positioned closely adjacent inner surface 96 of primer housing 60. In this manner, if the orientation of priming piston 74 should begin to deviate from longitudinal axis $L_1$—$L_1$ of primer assembly 60 during actuation thereof, outer rim 94 of guide plate 84 will slidably contact inner surface 96 of primer housing 62 to maintain the orientation of priming piston 74 along longitudinal axis $L_1$—$L_1$. In this manner, guide plate 84 aids in maintaining the travel of priming piston 74 along longitudinal axis $L_1$—$L_1$ of primer assembly 60.

Figure 6:
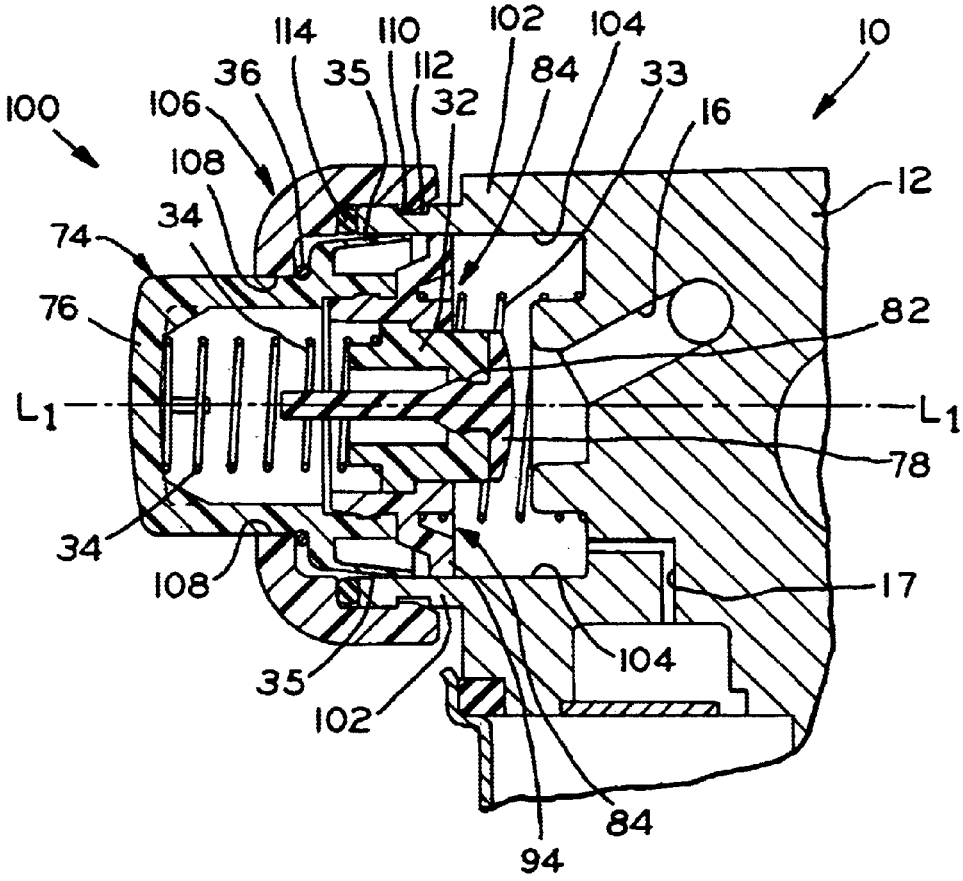
FIG. 6 is a fragmentary view of a portion of the carburetor of FIG. 1, showing a primer assembly in accordance with a third embodiment.

Referring to FIG. 6, primer assembly 100 is shown, according to a third embodiment. The components and operation of primer assembly 100 are substantially identical to the components and operation of primer assemblies 30 and 60, except as described below, and like reference numerals have been used to designate the same components therebetween.

Carburetor 10 includes circular wall 102 integrally formed with body 12 of carburetor 10, which extends outwardly from body 12 of carburetor 10 as shown in FIG. 6. The components of primer assembly 100, including priming piston 74, sealing piston 32, return springs 33 and 34, and guide plate 84, are received within circular wall 102 of carburetor, such that lip seal 35 of priming piston 74 and outer rim 94 of guide plate 84 are in slidable, guided contact with inner surface 104 of wall 102 of carburetor 10. Further, lip seal 35 of priming piston 74 is in sealing engagement with inner surface 104 of wall 102.

Additionally, primer assembly 100 includes cap 106 having hole 108 through which priming piston 74 is slidably and guidably received for confined movement along longitudinal axis $L_1$—$L_1$. Cap 106 further includes annular ridge 110 which locks within outer annular recess 112 in circular wall 102 of carburetor 10, and O-ring 114 is provided between cap 106 and circular wall 102 of carburetor 10 to provide an airtight seal therebetween.

In operation, primer assembly 100 functions in the same manner as primer assemblies 30 and 60 described above except that, in primer assembly 100, lip seal 35 of priming piston 74 and outer rim 94 of guide plate 84 slidably engage inner surface 104 of circular wall 102 of carburetor 10. Because circular wall 102 of carburetor 10 is made of rigid cast metal, the sliding relationship between primer piston 74 and guide plate 84 with circular wall 102 of carburetor 10 provides a rigid guiding of priming piston 74 and guide plate 84 along longitudinal access $L_1$—$L_1$ of during operation of primer assembly 100.

Additionally, easy assembly of primer assembly 100 is facilitated by cap 106. Specifically, after all the components of primer assembly 100, including priming piston 74, sealing piston 32, return springs 33 and 34, and guide plate 84 are received within circular wall 102 of carburetor 10, cap 106 is placed over priming piston 74 such that priming piston 74 projects through hole 108 of cap 106. Cap 106 is then pressed inwardly toward body 12 of carburetor 10 to lock ridge 110 of cap 106 within outer annular recess 112 in circular wall 102 of carburetor 10, thereby capturing the components of primer assembly 100 in their operative positions between cap 106 and carburetor 10.

Figure 7:
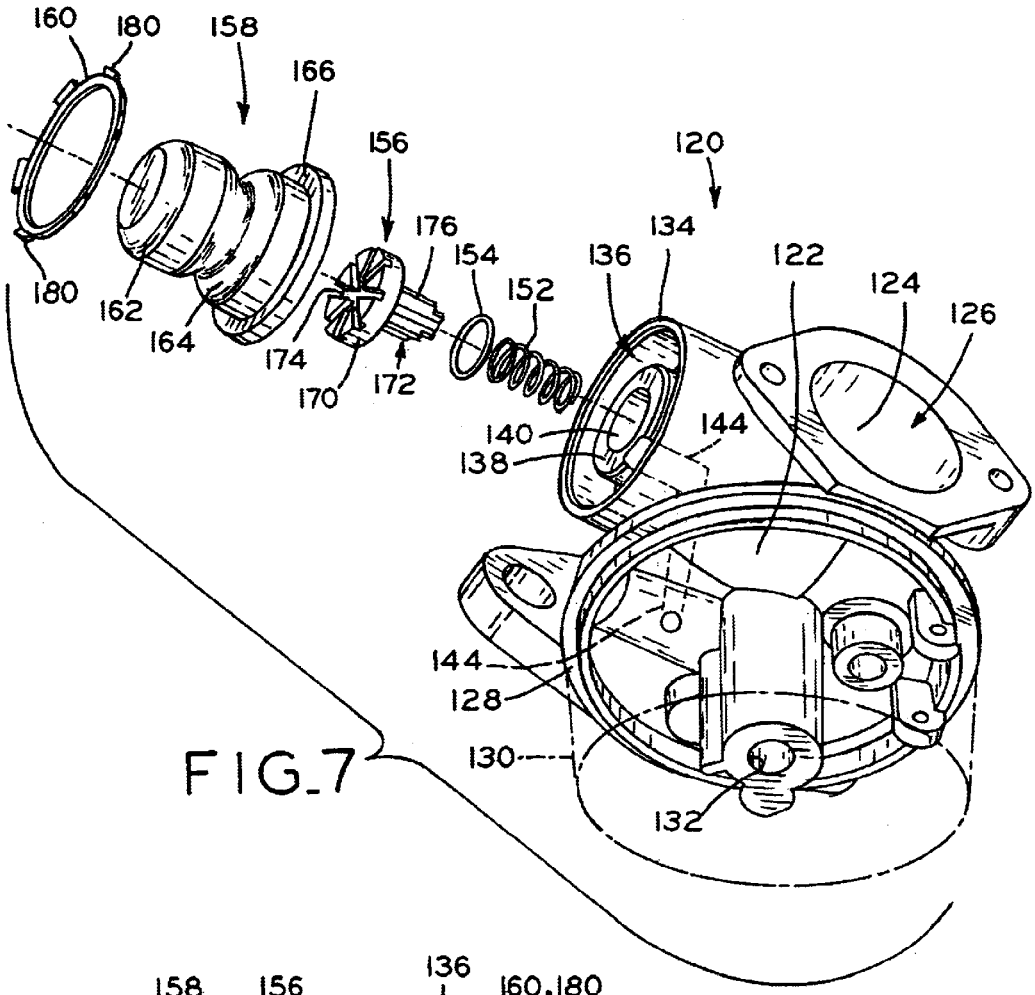
FIG. 7 is an exploded view of a carburetor and primer assembly according to a fourth embodiment.

A further embodiment of an air primer assembly for a carburetor, which includes a resilient primer bulb, is shown in FIGS. 7–10. Referring to FIG. 7, carburetor 120 includes carburetor body 122 having throat 124 extending therethrough between its inlet side 126 and its outlet side (not visible in FIG. 7). Carburetor 120 is similar to, and includes many features identical to carburetor 10 discussed above. Carburetor 120 also includes circular attachment portion 128 for attachment of fuel bowl 130 to carburetor body 122 by a screw-thread engagement or a press-fit, for example. Main fuel jet 132 extends from carburetor body 122 downwardly into fuel bowl 130 such that, during operation of carburetor 120, fuel is drawn from fuel bowl 130 upwardly through main fuel jet 132 and into throat 124 of carburetor 120 for mixture with air drawn into throat 124 through inlet side 126.

Figure 9:
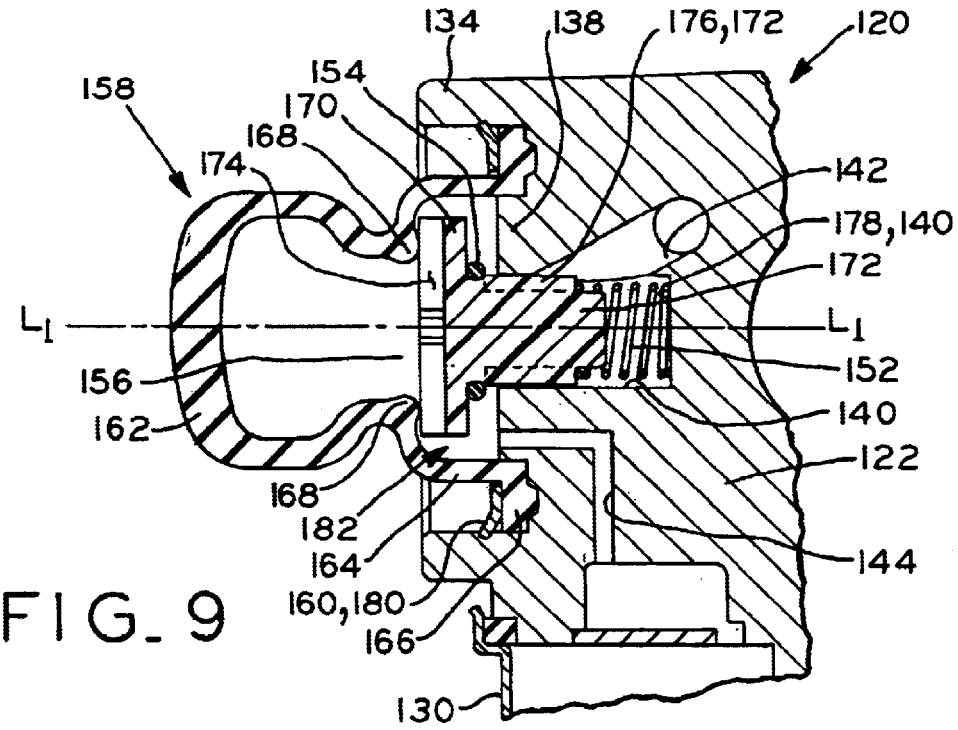
FIG. 9 is a fragmentary view of the primer assembly of FIG. 7 in a first position.
Figure 10:
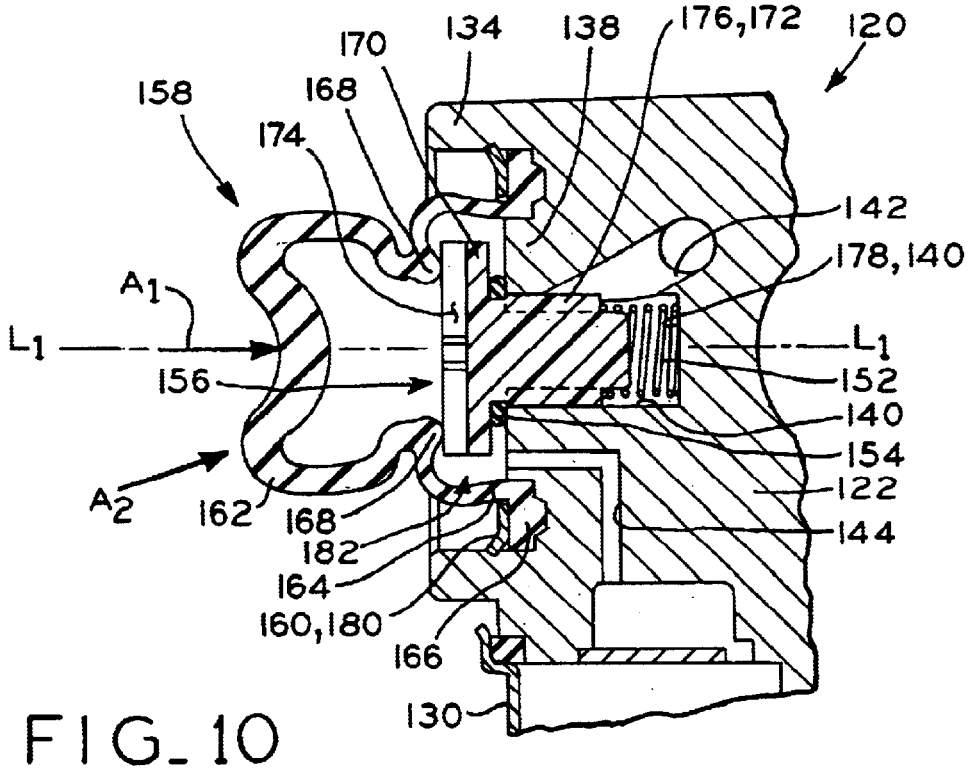
FIG. 10 is a fragmentary view of the primer assembly of FIG. 7 in a second position.

Carburetor 120 also includes a circular wall 134 projecting from body 122 and defining a cavity 136 (FIG. 7) in carburetor body 122. Boss 138 is disposed within cavity 136, and includes a blind bore 140 extending therethrough into body 122 of carburetor 120. Referring additionally to FIGS. 9 and 10, internal vent passageway 142 extends from bore 140 to throat 124 of carburetor 120. As shown in FIGS. 7, 9, and 10, priming passageway 144 extends from boss 138 within cavity 136 downwardly into fuel bowl 130.

Referring to FIG. 7, primer assembly 150 generally includes spring 152, O-ring 154, a plunger element or blocking element 156, primer bulb 158, and retainer ring 160. Primer bulb 158 is a resilient primer bulb made from a suitable flexible material such as rubber, for example, and includes head portion 162 and base portion 164. Base portion 164 includes annular flange 166 and, referring to FIG. 8, also includes an internal annular lip 168.

Plunger element or blocking element 156 includes head portion 170 and shaft portion 172 extending from head portion 170. Head portion 170 is shown herein as circular in shape, though the shape of head portion 170 may vary. Head portion 170 includes a series of radial grooves 174, each extending from a center portion of head portion 170 to the outer periphery of head portion 170. Shaft portion 172 of plunger element 156 includes four ridges 176 projecting therefrom, which are shown arranged 90° from one another.

Figure 8:
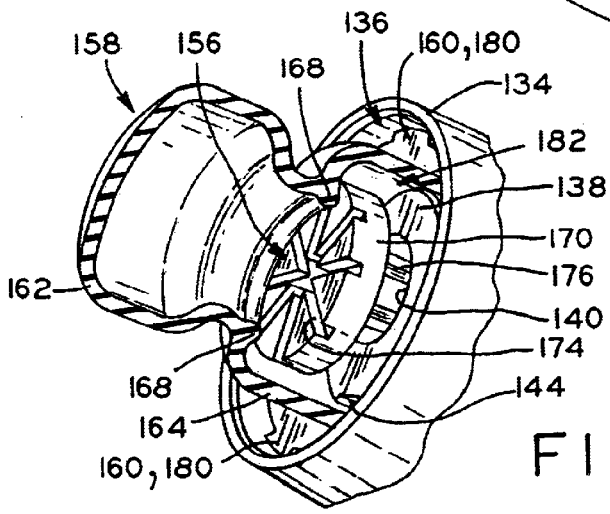
FIG. 8 is a perspective cutaway view of the primer assembly of FIG. 7.

To assemble primer assembly 150, O-ring 154 is inserted over the end of shaft portion 172 of plunger element 156 such that O-ring abuts head portion 170. Thereafter, shaft portion 172 of plunger element 156 is inserted through spring 152, and shaft portion 172 and spring 152 are inserted into bore 140 of carburetor body 122, with spring 152 disposed between ridges 176 of shaft 172 and end wall 178 of bore 140, as shown in FIG. 9. In this manner, plunger element 156 is confined for sliding movement within bore 140 along longitudinal axis $L_1$—$L_1$ of primer assembly 150. Thereafter, primer bulb 158 is fitted within circular wall 134 of carburetor body 122, with annular flange 166 of primer bulb 156 abutting carburetor body 122. Retainer ring 160 is press-fit into circular wall 134 to capture or sandwich annular flange 166 of primer bulb 156 between retainer ring 160 and carburetor body 122. Lock tabs 180 of retainer ring 160 deform during press-fit of retainer ring 160 into circular wall, and fixedly engage the interior surface of circular wall 134 of carburetor body 122 to lock primer bulb 158 in position. As shown in FIG. 8, annular lip 168 of primer bulb 158 abuts head portion 170 of plunger element 156 around the outer periphery of head portion 170.

When assembled, primer assembly 150 is normally disposed in the position shown in FIGS. 8 and 9, wherein spring 152 biases plunger element 156 outwardly from carburetor body 122 such that head portion 170 of plunger element 156 engages and is retained by annular lip 168 of primer bulb 156. In this position, plunger head 170 and O-ring 154 are spaced outwardly a small distance from carburetor body 122, as shown in FIGS. 8 and 9. Primer bulb 156 and carburetor body 122 together define a substantially enclosed primer chamber 182 which is in fluid, airflow communication with throat 124 of carburetor 120 through internal vent passageway 142, and is also in fluid, airflow communication with fuel bowl 130 through priming passageway 144.

The operation of primer assembly 150 will be described as follows. When an operator initially depresses head portion 162 of primer bulb 158, annular lip 168 of primer bulb 156 presses against head portion 170 of plunger element 156, thereby pressing plunger element 156 inwardly toward carburetor body 122 against the bias of spring 152. Concurrently, as the volume of primer chamber 182 is reduced, an initial amount of air within the interior of primer bulb 158 may pass as necessary through grooves 174 in plunger head 170 between plunger head 170 and annular lip 168. An initial amount of air may exit priming chamber 182 between bore 140 and ridges 176 of shaft portion 172 of plunger element 156 to enter internal vent passageway 142 of carburetor 120, and a further initial amount of air may pass from primer chamber 182 through priming passageway 144 and into fuel bowl 130.

However, depression of primer bulb 158 will very quickly move plunger element 156 toward carburetor body 122 such that O-ring 154 will engage carburetor body 122 as shown in FIG. 10, thereby sealing off airflow between bore 140 and ridges 176 of shaft portion 172 of plunger element 156 to block airflow communication between primer chamber 182 and internal vent passageway 142. Thus, only a minimal amount of air will escape priming chamber 182 in the manner described above before head portion 170 of plunger element 156 seals internal vent passage 142 from priming chamber 182 and fuel bowl 130.

Referring to FIG. 10, further depression of primer bulb 158 will force a relatively larger volume of air from within head portion 162 of primer bulb 155 through grooves 174 in head portion 170 of plunger element 156 and thence through priming passageway 144 into fuel bowl 130. Air entering fuel bowl 130 will pressurize the air space above the fuel in fuel bowl 130, forcing a quantity of priming fuel upwardly through main fuel jet 132 and into throat 124 of carburetor 120 for priming.

Upon release of primer bulb 158, primer bulb 158 will flex back to its natural position, shown in FIGS. 8 and 9, under its resilient restoring force. Concurrently, spring 152 will bias plunger element 156 outwardly of carburetor body 122 to the position shown in FIGS. 8 and 9. Upon movement of plunger element 156 outwardly of carburetor body 122, O-ring 154 unseats from carburetor body 122, and air is allowed to pass through either or both of internal vent passageway 142 and priming passageway 144 into the interior of primer bulb 158 and priming chamber 182 to occupy the expanding volume thereof. If needed, primer bulb 158 may be depressed and released more than once as described above during a priming operation to provide a desired amount of priming fuel to throat 124 of carburetor 120.

Advantageously, primer assembly 150 functions in the manner described above regardless of the direction in which primer bulb 158 is depressed. Normally, primer bulb 158 will be depressed along the direction of arrow $A_1$, which is coaxial with longitudinal axis $L_1$–$L_1$. However, even if primer bulb 158 is depressed from an angle which deviates from longitudinal axis $L_1$—$L_1$, such as from the direction of arrow $A_2$, annular lip 168 of primer bulb 158 will still engage a least a portion head portion 170 of plunger element 156 to depress plunger element 156 inwardly towards carburetor body 122, thereby sealing off internal vent passageway 142 such that air within primer bulb 158 and primer chamber 182 will pass only into fuel bowl 130 upon further depression of primer bulb 158. Thus, regardless of the direction from which primer bulb 158 is depressed, plunger element 156 is always engaged by annular lip 168 of primer bulb 158 and confined for sliding movement along longitudinal axis $L_1$—$L_1$. In this manner, primer assembly 150 is effective to properly pressurize fuel bowl 130 regardless of the direction from which primer bulb 158 is depressed by an operator.

In an alternate embodiment, primer bulb 158 lacks annular lip 168 and does not directly engage plunger element 156 when primer bulb 158 is depressed. However, upon initial depression of primer bulb 158, the reduction in volume of priming chamber 182 causes the air pressure within priming chamber 182 to rapidly increase, such that a greater amount of the air within priming chamber 182 is effectively forced against head portion 170 of plunger element 156 than that which is allowed to escape priming chamber 182 through internal vent passage 142 and priming passage 144. This increase in pressure causes plunger element 156 to move from the position shown in FIG. 9 to the position shown in FIG. 10 against the bias of spring 152 to thereby seal internal vent passageway 142 in the manner described above. Further depression of primer bulb 158 with plunger element 156 in the sealing position forces air from priming chamber 182 through priming passageway 144 into fuel bowl. In this manner, plunger element 156 is movable from the position shown in FIG. 9 to that shown in FIG. 10 without being directly contacted and engaged by primer bulb 158. In this embodiment, it may be necessary to incorporate a plunger retainer, attached to carburetor body 122, for example, which engages plunger element 156 when plunger element 156 is in its outwardly biased position of FIG. 9 in order to prevent plunger element 156 from separating completely from carburetor body 122.

While this invention has been describe as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A carburetor, comprising:

a carburetor body having a throat;

a fuel bowl connected to said carburetor body and storing a quantity of fuel, said fuel bowl in fluid communication with said throat;

an internal vent passage in fluid communication with said throat; and a primer assembly, comprising:

a piston assembly slidably supported by said carburetor body, said piston assembly and said carburetor body defining a variable volume primer chamber therebetween in fluid communication with said fuel bowl and with said internal vent passage, said piston assembly slidable with respect to said carburetor body to vary the volume of said primer chamber, said piston assembly including a portion moveable into blocking engagement with said internal vent passage to allow displacement of air from said primer chamber into said fuel bowl.

2. The carburetor of claim 1, wherein said carburetor body includes a circular wall having an inner surface, said piston assembly in sliding and sealing engagement with said inner surface.

3. The carburetor of claim 1, further comprising a cap attached to said carburetor body and having an opening, at least a portion of said piston assembly received through said opening of said cap and guidingly supported thereby.

4. The carburetor of claim 1, further comprising a priming passage within said carburetor body, said priming passage fluidly communicating said primer chamber and said fuel bowl.

5. The carburetor of claim 1, wherein said piston assembly comprises:

a first piston supported by said carburetor body for sliding movement relative to said carburetor body; and a second piston supported by said first piston for sliding movement relative to said first piston.

6. The carburetor of claim 5, wherein said second piston includes said portion moveable into blocking engagement with said internal vent passage.

7. The carburetor of claim 5, wherein said first and second pistons are supported for confined sliding movement along a common axis.

8. The carburetor of claim 5, further comprising a first return spring disposed under compression between said carburetor body and said first piston to bias said first piston outwardly from said carburetor body.

9. The carburetor of claim 8, further comprising a second return spring disposed under compression between said first and second pistons to bias said second piston into blocking engagement with said internal vent passage upon actuation of said piston assembly.

10. A carburetor, comprising:

a carburetor body having a throat;

a fuel bowl connected to said carburetor body and storing a quantity of fuel, said fuel bowl in fluid communication with said throat;

an internal vent passage in fluid communication with said throat; and a primer assembly, comprising:

a resilient primer bulb mounted to said carburetor body, said primer bulb and said carburetor body defining a variable volume primer chamber therebetween in fluid communication with said fuel bowl and with said internal vent passage, said primer bulb depressible to vary the volume of said primer chamber; and a blocking element separate from said primer bulb, said blocking element disposed within said primer chamber and movable into blocking relationship with said internal vent passage upon depression of said primer bulb to allow displacement of air from said primer chamber into said fuel bowl.

11. The carburetor of claim 10, wherein said blocking element is engaged by at least a portion of said primer bulb upon depression of said primer bulb to move said blocking element.

12. The carburetor of claim 11, wherein said primer bulb includes an internal annular lip engaging said blocking element.

13. The carburetor of claim 11, wherein said blocking element includes at least one passageway through which air may pass between said primer bulb and said blocking element.

14. The carburetor of claim 10, further comprising a priming passage fluidly communicating said primer chamber and said fuel bowl.

15. The carburetor of claim 10, wherein said blocking element is slidably supported by said carburetor body for confined movement along an axis.

16. The carburetor of claim 10, wherein said carburetor body includes a bore in which at least a portion of said blocking element is slidably received, said internal vent passage extending from said bore.

17. The carburetor of claim 10, wherein said internal vent passage extends into said carburetor body from said primer chamber, said blocking element moveable into sealing engagement with said carburetor body upon depression of said primer bulb to block fluid communication between said primer chamber and said internal vent passage.

18. The carburetor of claim 10, further comprising a return spring between said blocking element and said carburetor body, said return spring biasing said blocking element outwardly of said carburetor body.

19. The carburetor of claim 10, further comprising:

an annular wall projecting from said carburetor body and defining a cavity in which at least a portion of said primer bulb is received; and a retainer element engageable with said annular wall to capture said portion of said primer bulb between said retainer element and said carburetor body.

20. A method of priming a carburetor for starting an internal combustion engine, comprising the steps of:

depressing a resilient primer bulb to move a blocking element into blocking relationship with an internal vent passage of the carburetor to seal a fuel bowl of the carburetor from the internal vent passage, wherein the blocking element is separate from the primer bulb; and depressing the primer bulb further to displace air from within the primer bulb into the fuel bowl to pressurize the fuel bowl and force fuel from the fuel bowl into a throat of the carburetor.

21. The method of claim 20, wherein said first depressing step further comprises engaging a portion of said primer bulb with said blocking element to move the blocking element toward a body of the carburetor and into blocking relationship with the internal vent passage.

22. The method of claim 20, further comprising the additional step of releasing the primer bulb to allow a return spring to bias the blocking element out of blocking relationship with the internal vent passage such that air may re-enter the primer bulb.

23. A carburetor, comprising:

a carburetor body having a throat;

a fuel bowl connected to said carburetor body and scoring a quantity of fuel, said fuel bowl in fluid communication with said throat;

an internal vent passage in fluid communication with said throat; and a primer assembly, comprising:

a resilient primer bulb mounted to said carburetor body, said primer bulb and said carburetor body defining a variable volume primer chamber therebetween in fluid communication with said fuel bowl and with said internal vent passage, said primer bulb depressible to vary the volume of said primer chamber; and a rigid blocking element disposed within said primer chamber and movable into blocking relationship with said internal vent passage upon depression of said primer bulb to allow displacement of air from said primer chamber into said fuel bowl.

24. A carburetor, comprising:

a carburetor body having a throat;

a fuel bowl connected to said carburetor body and storing a quantity of fuel, said fuel bowl in fluid communication with said throat;

an internal vent passage in fluid communication with said throat; and a primer assembly, comprising:

a resilient primer bulb mounted to said carburetor body, said primer bulb and said carburetor body defining a variable volume primer chamber therebetween in fluid communication with said fuel bowl and with said internal vent passage, said primer bulb depressible to vary the volume of said primer chamber; and a blocking element disposed within said primer chamber and confined by said carburetor body for sliding movement along an axis into blocking relationship with said internal vent passage upon depression of said primer bulb to allow displacement of air from said primer chamber into said fuel bowl.

* * * * *

UNITED STATES PATENT AND TRADEMARK OFFICE

CERTIFICATE OF CORRECTION

PATENT NO. : 6,840,508 B2
DATED : January 11, 2005
INVENTOR(S) : Pavel Krlin et al.

It is certified that error appears in the above-identified patent and that said Letters Patent is hereby corrected as shown below:

Column 13,
Line 13, delete “scoring” and insert -- storing --.

Signed and Sealed this

Third Day of May, 2005

JON W. DUDAS
*Director of the United States Patent and Trademark Office*